US011123593B2

(12) United States Patent
Souffrain

(10) Patent No.: US 11,123,593 B2
(45) Date of Patent: Sep. 21, 2021

(54) EXERCISE ACCESSORIES AND SYSTEM

(71) Applicant: Juan Ernesto Souffrain, Cliffside Park, NJ (US)

(72) Inventor: Juan Ernesto Souffrain, Cliffside Park, NJ (US)

( * ) Notice: Subject to any disclaimer, the term of this patent is extended or adjusted under 35 U.S.C. 154(b) by 42 days.

(21) Appl. No.: 16/867,755

(22) Filed: May 6, 2020

(65) Prior Publication Data

US 2020/0261758 A1 Aug. 20, 2020

Related U.S. Application Data

(63) Continuation-in-part of application No. 15/429,177, filed on Feb. 10, 2017, now Pat. No. 10,695,601.

(51) Int. Cl.

| | |
|---|---|
| ***A63B 21/04*** | (2006.01) |
| ***A63B 24/00*** | (2006.01) |
| ***A63B 21/055*** | (2006.01) |
| ***A63B 21/00*** | (2006.01) |
| ***A63B 23/02*** | (2006.01) |
| ***A63B 1/00*** | (2006.01) |

(52) U.S. Cl.

CPC ..... *A63B 21/0442* (2013.01); *A63B 1/00* (2013.01); *A63B 21/00069* (2013.01); *A63B 21/0555* (2013.01); *A63B 21/0557* (2013.01); *A63B 21/4015* (2015.10); *A63B 21/4017* (2015.10); *A63B 23/0216* (2013.01); *A63B 24/0062* (2013.01); *A63B 2208/029* (2013.01); *A63B 2225/50* (2013.01)

(58) Field of Classification Search

CPC ..... A63B 21/0442; A63B 24/0062; A63B 21/0557; A63B 21/00069; A63B 21/0555; A63B 21/4017; A63B 23/0216; A63B 21/4015; A63B 1/00; A63B 2208/029; A63B 2225/50; A63B 21/068; A63B 2210/50; A63B 2220/833; A63B 2225/10; A63B 71/023; A63B 2071/026; A63B 2225/09; A63B 23/1218; A63B 71/0036; A63B 2209/00; A63B 2071/0072

See application file for complete search history.

(56) References Cited

U.S. PATENT DOCUMENTS

| | | | | | |
|---|---|---|---|---|---|
| 843,478 | A * | 2/1907 | Müller | A63B 21/0552 | 482/124 |
| 2,574,178 | A * | 11/1951 | Haller | A62B 35/0031 | 182/3 |
| 3,593,708 | A * | 7/1971 | Steele | A63B 21/1627 | 602/32 |

(Continued)

*Primary Examiner* — Garrett K Atkinson

(74) *Attorney, Agent, or Firm* — Michael C. Balaguy

(57) ABSTRACT

An exercise accessory may be a component of a leg lift exercise system assembly. The exercise accessory may be useful for a user to hold themselves up by the arms to perform leg lifts, among other exercises. The accessory has an angular adjuster to allow a user to adjust the positioning of his or her forearms during the exercise. The angular adjuster has a cage which can attach to and suspend from an overhead bar, and an apertured base having radial tines. An indexer may be able to rotatably index to and rest within the radial tines. Rotating the indexer when tension is not applied to the system allows the user to adjust angular positioning. From the indexer and through the aperture an arm support is suspended.

18 Claims, 11 Drawing Sheets

(56) References Cited

U.S. PATENT DOCUMENTS 4,527,289 A * 7/1985 Shea ..... A41F 9/002 2/322
4,685,671 A * 8/1987 Hagerman ..... A63B 21/04 482/124
4,826,153 A * 5/1989 Schalip ..... A63B 21/06 482/94
4,984,786 A * 1/1991 Lemke ..... A63B 21/4001 482/105
5,048,825 A * 9/1991 Kelly ..... A63B 21/1636 482/94
5,147,261 A * 9/1992 Smith ..... A61F 5/028 2/338
5,201,694 A * 4/1993 Zappel ..... A63B 21/00072 482/133
5,279,386 A * 1/1994 Cearley ..... A62B 35/0031 119/907
5,290,209 A * 3/1994 Wilkinson ..... A63B 21/00047 482/121
5,318,495 A * 6/1994 Malynowsky ..... A63B 21/023 482/129
5,362,295 A * 11/1994 Nurge ..... A63B 21/00061 482/121
5,399,139 A * 3/1995 Malynowsky ..... A63B 21/023 248/188.7
5,403,253 A * 4/1995 Gaylord ..... A63B 21/068 482/140
5,411,461 A * 5/1995 Thomascik ..... A63C 3/00 280/1.5
5,518,486 A * 5/1996 Sheeler ..... A63B 21/0004 482/131
5,662,556 A * 9/1997 Gangloff ..... A63B 1/005 482/17
5,810,702 A * 9/1998 Wilkinson ..... A63B 21/00047 482/130
5,848,956 A * 12/1998 Grettner ..... A63B 21/4017 482/69
5,871,424 A * 2/1999 Conner ..... A63B 21/0552 482/129
6,050,364 A * 4/2000 Popall ..... A62B 35/0031 182/6
7,032,529 B2 * 4/2006 Sanford ..... B63B 21/00 114/230.2
7,255,666 B2 * 8/2007 Cardenas ..... A61H 1/0229 482/143
7,503,736 B1 * 3/2009 Chen ..... B60P 7/083 410/100
7,540,831 B2 * 6/2009 Hauser ..... A63B 1/00 482/40
7,575,136 B2 * 8/2009 Kernkamp ..... A45F 3/14 224/158
7,811,202 B2 * 10/2010 Planke ..... A63B 7/02 482/7
7,837,598 B1 * 11/2010 Boozel, Jr. ..... A63B 23/03525 482/38
8,038,584 B1 * 10/2011 Pruessner ..... A61H 11/00 482/91
8,152,704 B2 * 4/2012 Brice ..... A63B 21/00 482/129
8,197,392 B2 * 6/2012 Silverman ..... A63B 21/16 482/91
8,267,840 B2 * 9/2012 Barnes ..... A63B 21/00 482/95
8,678,983 B1 * 3/2014 Brown ..... A63B 21/068 482/91
8,858,408 B2 * 10/2014 DeMeo ..... A63B 21/0442 482/131
8,920,294 B2 * 12/2014 Davis ..... A63B 7/00 482/143
9,375,596 B2 * 6/2016 Davis ..... A63B 7/00
9,504,867 B2 * 11/2016 Hall ..... A63B 21/0722
9,573,015 B2 * 2/2017 Hall ..... A63B 21/0722
9,821,188 B2 * 11/2017 Dwork ..... A63B 7/02
9,884,239 B2 * 2/2018 Kay ..... A63B 24/0087
10,245,460 B2 * 4/2019 Hetrick ..... A63B 21/4043
10,252,099 B2 * 4/2019 Karpachevskyy ... A63B 21/068
10,702,734 B2 * 7/2020 Pompile ..... A63B 21/4033
2003/0027698 A1 * 2/2003 Matsuoka ..... A63B 21/0004 482/124
2003/0078142 A1 * 4/2003 Jacobsen ..... A63B 21/4011 482/126
2003/0130098 A1 * 7/2003 Marco ..... A63B 21/4015 482/124
2005/0227833 A1 * 10/2005 Wilkinson ..... A63B 21/4017 482/124
2005/0251895 A1 * 11/2005 Farrah ..... A63B 69/0064 2/227
2006/0052222 A1 * 3/2006 Cardenas ..... A63B 7/00 482/96
2007/0213186 A1 * 9/2007 Longo ..... A63B 21/169 482/121
2009/0111661 A1 * 4/2009 Hauser ..... A63B 23/12 482/40
2010/0292058 A1 * 11/2010 Barnes ..... A63B 21/4029 482/139
2011/0166003 A1 * 7/2011 Brice ..... A63B 21/00 482/131
2012/0035031 A1 * 2/2012 Silverman ..... A63B 7/00 482/139
2012/0202660 A1 * 8/2012 Silverman ..... A63B 21/1645 482/131
2012/0214651 A1 * 8/2012 Ross ..... A63B 7/00 482/129
2013/0143724 A1 * 6/2013 DeMeo ..... A63B 23/03508 482/131
2013/0217547 A1 * 8/2013 Hinds ..... A63B 21/4035 482/96
2014/0005015 A1 * 1/2014 Hester ..... A63B 21/4035 482/131
2014/0073493 A1 * 3/2014 Parish ..... A63B 21/0783 482/104
2014/0073496 A1 * 3/2014 Bannerman ..... A63B 23/0355 482/139
2015/0024911 A1 * 1/2015 Ross ..... A63B 23/1218 482/129
2015/0045194 A1 * 2/2015 Sheets ..... A63B 21/068 482/139
2015/0057133 A1 * 2/2015 Nguyen ..... A63B 21/4021 482/93
2016/0023051 A1 * 1/2016 Lauener ..... A63B 7/00 482/143
2016/0263461 A1 * 9/2016 Kay ..... A63B 24/0087
2016/0303419 A1 * 10/2016 Karpachevskyy ..... A63B 21/1636
2018/0071574 A1 * 3/2018 Reder ..... A63B 23/0205
2018/0085622 A1 * 3/2018 Ivan ..... A63B 1/00
2018/0140886 A1 * 5/2018 Hetrick ..... A63B 23/03541
2018/0264312 A1 * 9/2018 Pompile ..... A63B 23/1281
2018/0272177 A1 * 9/2018 Negron ..... A63B 21/04
2019/0091507 A1 * 3/2019 Hetrick ..... A63B 23/03575

* cited by examiner

EXERCISE ACCESSORIES AND SYSTEM

CROSS REFERENCE TO RELATED APPLICATION

The present application is a Continuation-in-Part and is related to and claims priority to U.S. Provisional Patent Application No. 62/418,421 filed Nov. 7, 2016, and pending U.S. Non-Provisional patent application Ser. No. 15/429,177 filed Feb. 10, 2017, which are incorporated by reference herein in their entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of exercise and more specifically relates to exercise accessories.

2. DESCRIPTION OF RELATED ART

Exercise is a task that people should endure on a regular basis. With people's busy schedules, any simplification to the exercise routines helps entice people to exercise. Exercise straps have recently grown in popularity, particularly for abdominal training. Such exercise straps are usually made of nylon anchored to a fixed object and are of sufficient strength to support a person's weight. They generally consist of three components. On one end, there is the anchoring portion of the strap, usually a clip of some type. The middle portion is several feet of nylon strap to support a person's weight. At the other end, there is a handle. In a gym setting, exercise straps are typically anchored to the ceiling or a pull-up bar. The user usually fastens the suspension strap to the anchoring device by either wrapping the strap around the anchoring device or locking it into place with a clip hook connected directly to a closed loop anchor.

The major drawback of home exercise equipment is lack of user knowledge in proper use or proper form. Improper use or improper form can result in serious injuries, broken equipment, and/or lack of results. Thus, there is clearly a need for home exercise equipment that allows for proper use.

U.S. Pat. No. 8,858,408 to DeMeo relates to a double loop exercise strap. The described double loop exercise strap includes an outer strap anchored to a fixed object (e.g., a wall, rail or other fixed platform) and an inner strap that wraps firmly around a limb, extremity (e.g., hand or foot) or torso of the human body. The inner strap has two ends, a fixed end that may advantageously be sewn or attached to the outer strap and a free end that wraps around the human limb, extremity or torso and is threaded through an outer strap slot before being attached to the outside of the outer strap using VELCRO™, buckles or other types of fasteners to thereby create a closed double loop system. The reference to DeMeo is representative of previous solutions for exercise systems.

BRIEF SUMMARY OF THE INVENTION

In view of the foregoing disadvantages inherent in the known exercise art, the present disclosure provides a novel exercise accessories and system. The general purpose of the present disclosure, which will be described subsequently in greater detail, is to provide an exercise system and associated exercise accessories.

An exercise accessory is disclosed herein. The exercise accessory may be a component of a leg lift exercise system assembly. The exercise accessory may be useful for a user to hold themselves up by the arms to perform leg lifts, among other exercises. The accessory has an angular adjuster to allow a user to adjust the positioning of his or her forearms during the exercise. The angular adjust has a cage which can attach to and suspend from an overhead bar, and an apertured base having radial tines. An indexer may be able to rotatably index to and rest within the radial tines. Rotating the indexer when tension is not applied to the system allows the user to adjust angular positioning. From the indexer and through the aperture an arm support and a hand grip are suspended.

Another exercise accessory is also disclosed herein. The exercise accessory includes a resistance-band which may include a first-end, a second-end opposite the first-end and a length therebetween. The first-end may include a first attachment-clip, and the second-end may include a second attachment-clip. Further, a foot-section may include at least one attachment-hook and at least one adjustable-strap, the at least one attachment-hook being configured for attachment to one of the first attachment-clip and the second attachment-clip. The foot-section may be configured to receive and hold a foot of a user.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an exercise accessories and system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercise means and more particularly to exercise accessories and a system as used to improve the means for efficient and effective exercise.

Disclosed is an exercise system including associated exercise accessories. One such exercise accessory may be a resistance band including a foot strap. The foot strap may be made from a hard/flexible rubber allowing for easy cleaning and no absorption of sweat. The foot strap may further include a buckle that can tighten to facilitate virtually any foot size. Behind the foot strap may be a half circle hook which may allow the resistance bands to clip to it. One half circle hook may also be located on the side, so that when doing exercises, a user can also go sideways. The half circle hook may take many shapes (it is not limited to a half circle shape). The hook may be sized to receive a plurality of resistance bands, such that if the user wants to create more resistance, they can clip on a plurality of resistance bands. The resistance band may be six-foot long.

On one end of the resistance band right before the clip there may be two buttons on the side that can be pressed in and moved forward and back on resistance band. Once let go, the button may lock. On this side of the resistance band there may be a flat piece so that once it gets to the end of the resistance band it can't go further. The flat piece may be located at the end, before the clip, so that whenever the length is being changed, it may never come off. As the user makes the resistance band shorter, the excess resistance band may hang to the side.

Another exercise accessory may include an anchor. The resistance band may be attached to the anchor. The anchor may be a door anchor which may be placed under a door outside of the door, then shut the door, so the door is like a wall to create resistance. The door anchor may be used anywhere as long as it attached. In another embodiment, the anchor may be a wall anchor. In this embodiment, holes may be provided in the anchor, so it may be screwed onto a wall. The resistance band may be clipped to the anchor via a half circle hook.

Figure 6:
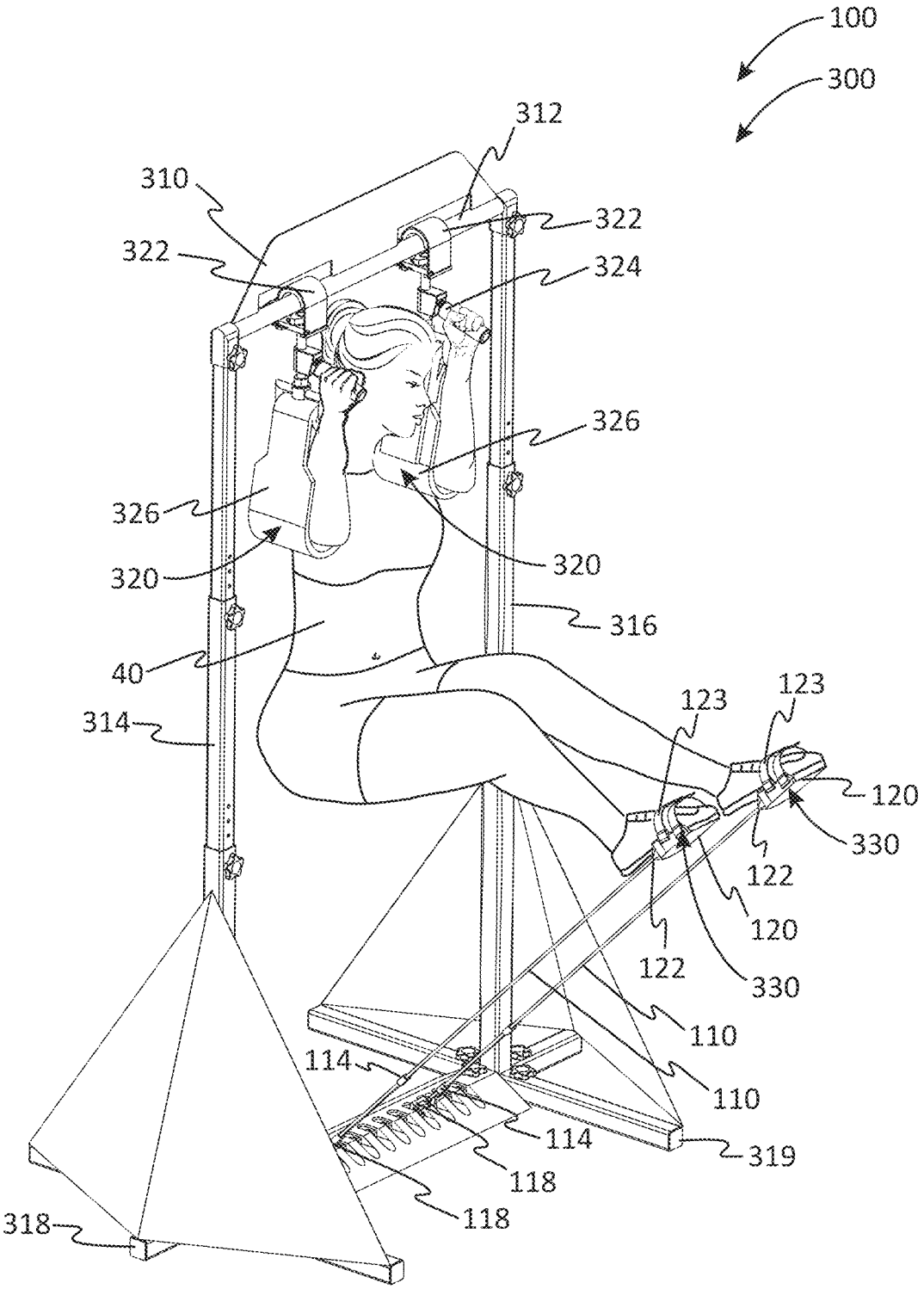
FIG. 6 is a perspective view of an exercise system in-use, according to an embodiment of the present disclosure.

Yet another exercise accessory may include an arm-support exercise accessory. The arm-support exercise accessory may include an angular adjuster able to swing as suspend from a horizontal bar, an arm support, a suspension-member suspending the arm support from the angular adjuster, and a hand-grip attached to the suspension-member between the angular-adjuster and the arm support. The intended use of this accessory is shown in FIG. 6. A user slides his or her upper arms through the arm support and grasps the hand-grip with their hands. As shown, one arm-support exercise accessory should be used with each arm. The arm-support may take the form of a sling that can circumscribe and support the upper arms. The hand-grip cantilevers out from the suspension-member forwardly from the user's perspective, such that the user can position the elbow at a right angle with the forearms pointed upwardly.

The exercise system may include a collapsible support system which provides a foldable, travel-friendly pull up bar and accessory combination for use in the home, or virtually anywhere. From this support system, the resistance bands may be mounted, as well as the arm-support exercise accessory. As a whole, this system may be used for leg lifts, as illustrated in FIG. 6.

A smart resistance bands system is also disclosed herein. The smart resistance bands system includes a smart resistance band system comprising a resistance-band including a first-end and a second-end. The second-end is opposite the first-end and a length is defined therebetween. The first-end includes an attachment-clip, and the second-end is attached to an exercise-attachment and a power source. The exercise-attachment may be removably attached or fixed to the second-end of the resistance-band. The smart resistance bands system is further equipped with wireless connectivity (BLUETOOTH®) capabilities and is in communication with a network and at least one smart device. The resistance-bands include a sensor system configured to track user parameters, workout metrics, and communicate data directly to the at least one smart device. In a preferred embodiment, the electronics of the system (transceivers, processors, power sources, sensors, etc.) are contained within shoe or boot affixed to one end of the resistance band.

A method of using smart resistance bands system is also disclosed herein. The method of using smart resistance bands system may comprise the steps of: providing a resistance-band including a first-end, a second-end opposite the first-end and a length defined therebetween, the first-end including an attachment-clip, and the second-end being attached to an exercise-attachment; and communicating power from a power source; wherein the smart resistance bands system is further equipped with wireless connectivity capabilities and is in communication with a network and at least one smart device; and wherein the resistance-bands include a sensor system configured to track user parameters, workout metrics, and communicate data directly to the at least one smart device; pairing the resistance-band and the exercise-attachment to the at least one smart device; attaching the resistance-band to a workout machine; performing a workout using the resistance-band and the exercise-attachment; and removing.

Referring now more specifically to the drawings by numerals of reference, there is shown in FIGS. 1-9, various views of an exercise accessory 100.

Figure 1:
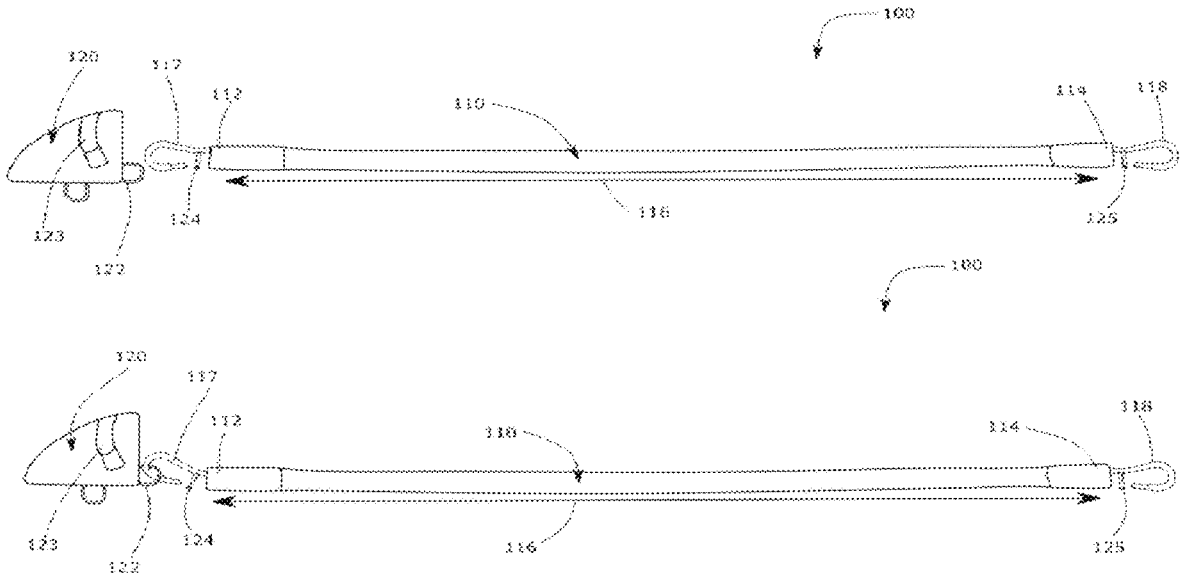
FIG. 1 is a side perspective view of the resistance band exercise accessory for an exercise system, according to an embodiment of the disclosure.

FIG. 1 shows an exercise accessory 100 according to an embodiment of the present disclosure. As illustrated, the exercise accessory 100 may include a resistance-band 110 and a foot-section 120. In a preferred embodiment, the resistance-band 110 may comprise a durable rubber material.

As shown, the resistance-band 110 may include a first-end 112, a second-end 114 opposite the first-end 112 and a length 116 therebetween. The first-end 112 may include a first attachment-clip 117 and the second-end 114 may include a second attachment-clip 118. The first attachment-clip 117 may include a first spring-loaded gate 124 configured to bias in a closed position under a spring pressure, and to move into an open position when the spring pressure is overcome. Similarly, the second attachment-clip 118 may include a second spring-loaded gate 125 configured to bias in the closed position under the spring pressure, and to move into the open position when the spring pressure is overcome.

Moreover, as illustrated, the foot-section 120 may include at least one attachment-hook 122 and at least one adjustable-strap 123. As shown in this figure, the at least one attachment-hook 122 may be configured for attachment to one of the first attachment-clip 117 and the second attachment-clip 118.

Figure 2:
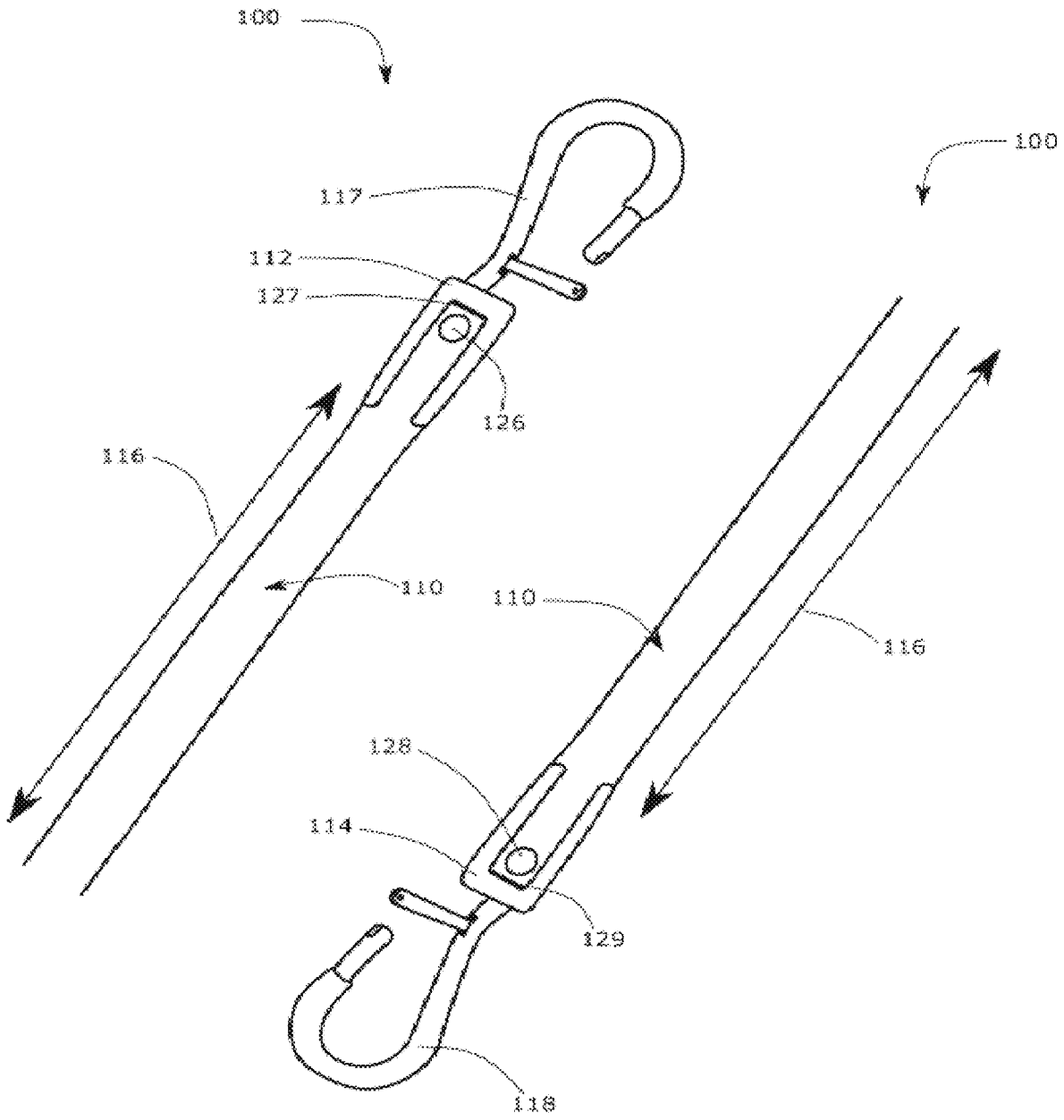
FIG. 2 is a perspective view of the attachment-clip of the resistance band exercise accessory of FIG. 1, according to an embodiment of the present disclosure.

FIG. 2 shows a rear perspective view of the exercise accessory 100 of FIG. 1, according to an embodiment of the present disclosure. In a preferred embodiment, the first attachment-clip 117 may be moveable along the length 116 of the resistance-band 110. In this embodiment, the first-end 112 may include a first adjustable-button 126 configured to selectively unlock and lock the first attachment-clip 117 along the length 116 of the resistance-band 110. In addition to this, the first-end 112 may include a first clip-stopper 127 to prevent removal of the first attachment-clip 117 from the first-end 112 of the resistance-band 110.

Likewise, in the preferred embodiment, the second attachment-clip 118 may be moveable along the length 116 of the resistance-band 110. Again, in this embodiment the second-end 114 may include a second adjustable-button 128 configured to selectively unlock and lock the second attachment-clip 118 along the length 116 of the resistance-band 110. Moreover, the second-end 114 may include a second clip-stopper 129 to prevent removal of the second attachment-clip 118 from the second-end 114 of the resistance-band 110.

Figure 3:
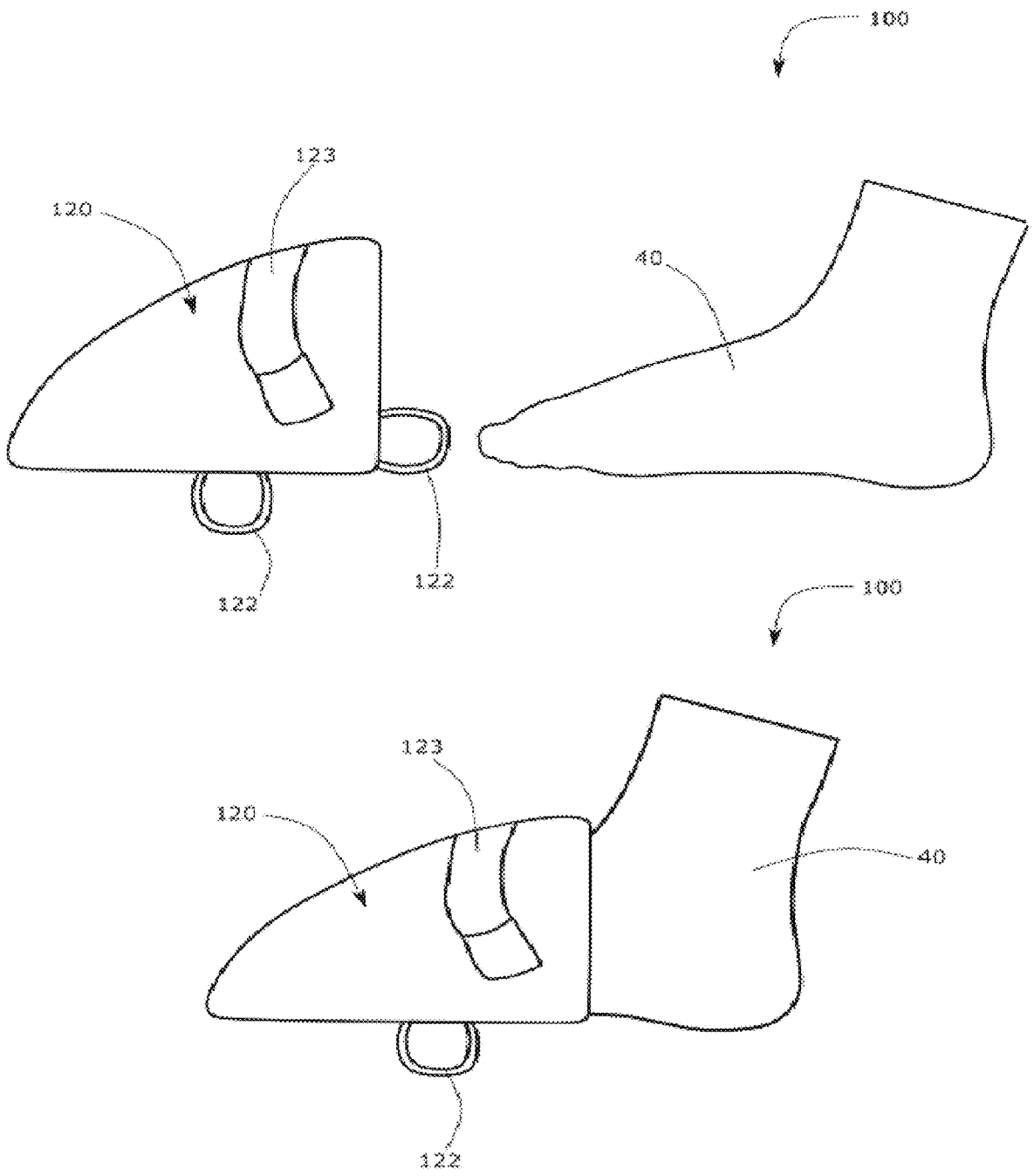
FIG. 3 is a side perspective view of the shoe of the resistance band exercise accessory of FIG. 1, according to an embodiment of the present disclosure.

FIG. 3 shows a side perspective view of the exercise accessory 100 of FIG. 1, according to an embodiment of the present disclosure. As shown here, the foot-section 120 may be configured to receive and hold a foot of a user 40. The adjustable-strap 123 may be configured to selectively tighten and loosen the foot-section 120 around the foot of the user 40 such that when the user 40 is using the resistance-band 110, their foot is securely within the foot-section 120 and will not fall out. In addition to this, in the preferred embodiment, the at least one attachment-hook 122 may include two attachment-hooks. As shown here, one attachment-hook is located on an end of the foot-section 120, and one attachment-hook is located on a side of the foot-section 120. This may allow the user 40 to attach the resistance-band 110 (FIG. 2) to either attachment-hook to target different muscles. For example, attaching the resistance-band 110 (FIG. 2) to the attachment-hook 122 located on the side of the foot-section 120 may specifically target oblique muscles.

Figure 4:
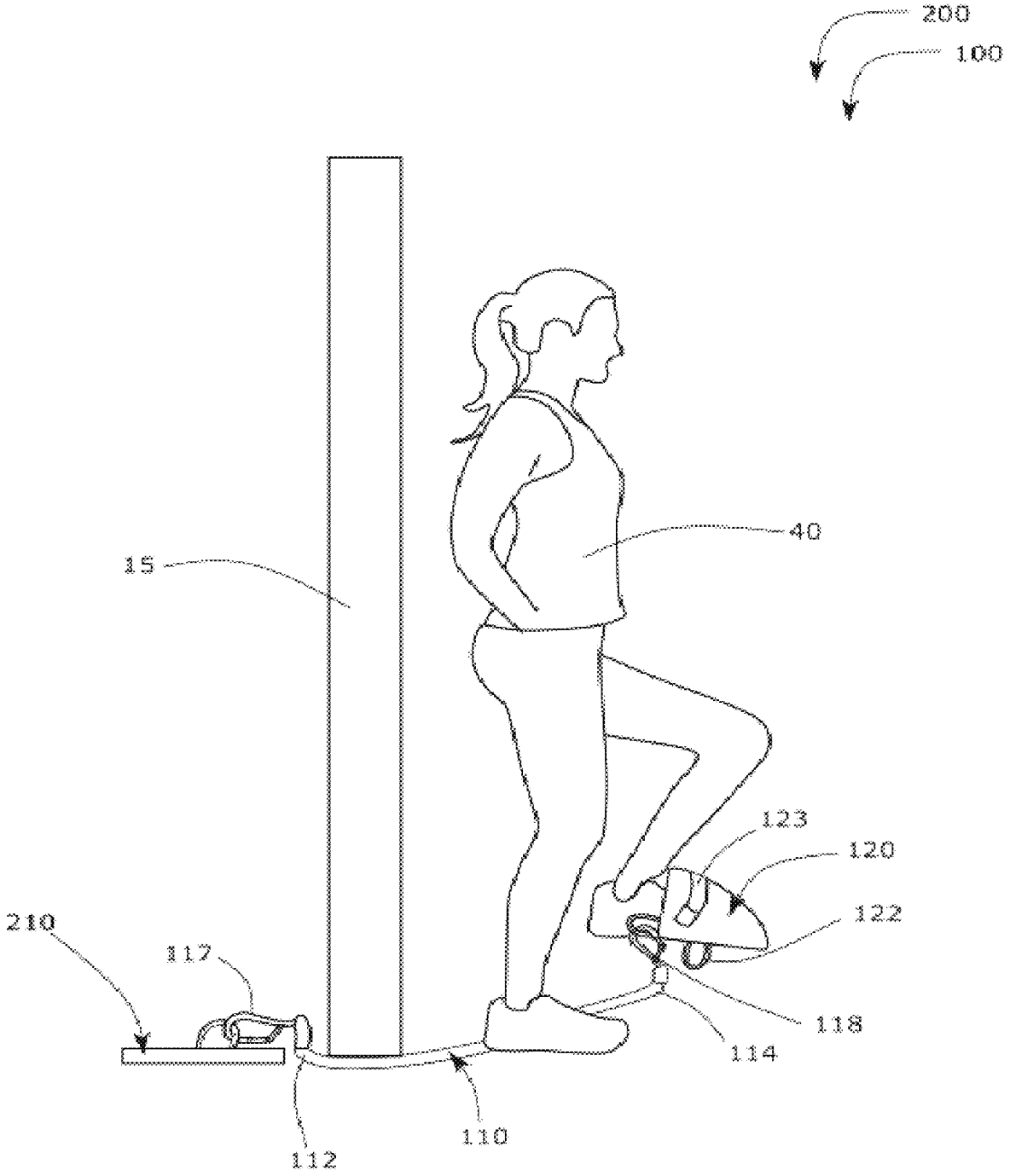
FIG. 4 is a side perspective view of an exercise system and a user using the resistance band exercise accessory, according to an embodiment of the present disclosure.

FIG. 4 shows a side perspective view of an exercise-system 200, according to an embodiment of the present disclosure. As illustrated, the exercise-system 200 may include the exercise accessory 100 as above including at least one resistance-band 110 and at least one foot-section 120; and an anchor 210.

As above, the at least one resistance-band 110 may include the first-end 112, the second-end 114 opposite the first-end 112 and the length 116 therebetween, the first-end 112 including the first attachment-clip 117, and the second-end 114 including the second attachment-clip 118. Also, the at least one foot-section 120 may include the at least one first attachment-hook 122 and the at least one adjustable-strap 123, the at least one attachment-hook 122 being configured for attachment to one of the first attachment-clip 117 and the second attachment-clip 118, and the foot-section 120 may be configured to receive and hold a foot of a user 40. As shown in this figure, the anchor 210 may be configured for placement behind a door 15. In this figure, the user 40 is shown to have attached the anchor 210 to the resistance-band 110, placed the anchor 210 behind the door 15 and is using the door 15 to provide resistance whilst using the resistance-band 110.

Figure 5:
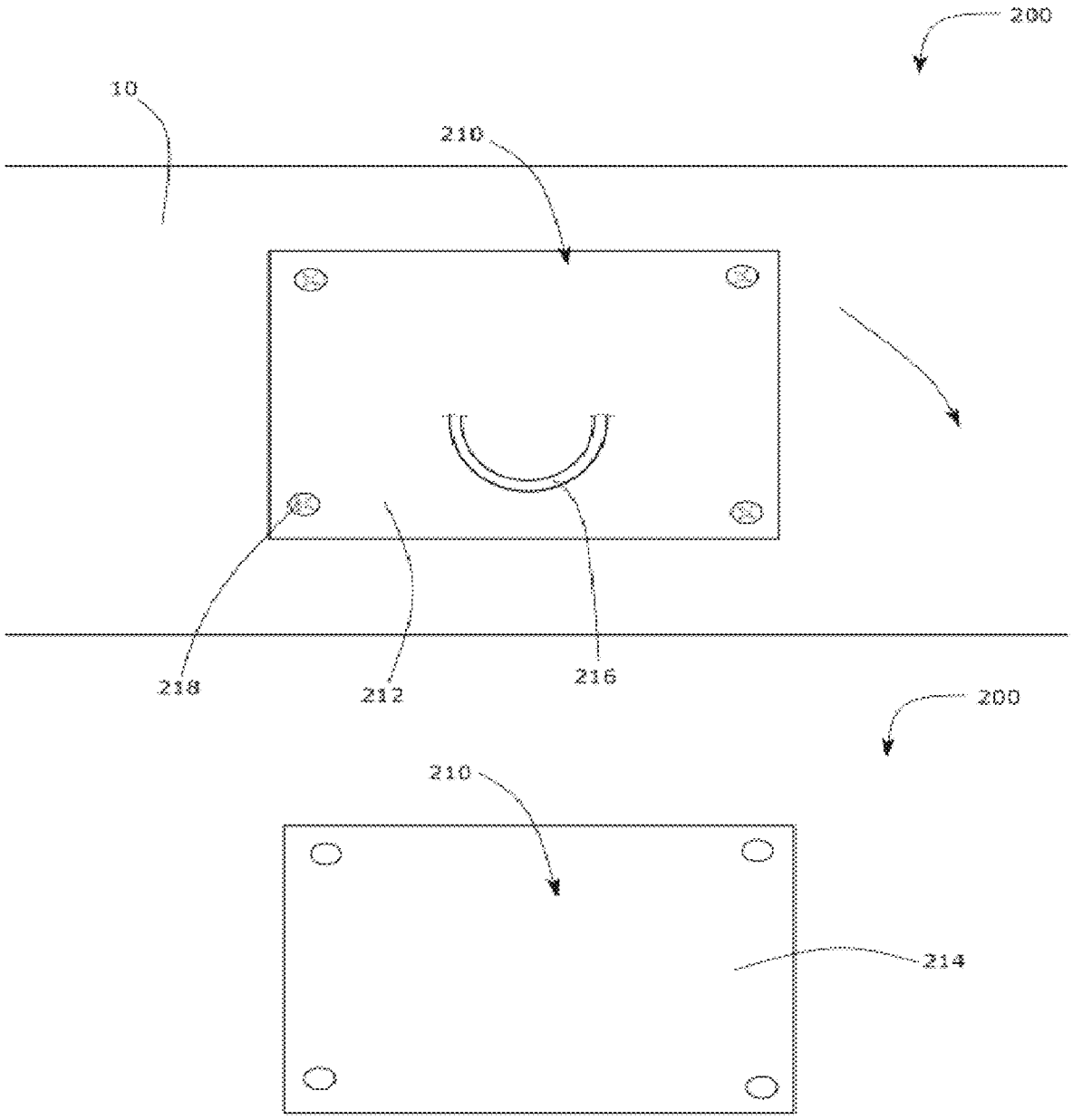
FIG. 5 is a top perspective view of the base of the exercise system of FIG. 4, according to an embodiment of the present disclosure.

FIG. 5 shows a front perspective view of the exercise-system 200 of FIG. 4, according to an embodiment of the present disclosure. As shown, the anchor 210 may include a front-surface 212 and a rear-surface 214 opposite the front-surface 212. The front-surface 212 may include at least one second attachment-hook 216, and the at least one second attachment-hook 216 may be configured for attachment to another one of the first attachment-clip 117 and the second attachment-clip 118 of the resistance-band 110 (FIG. 4). In one embodiment, the rear-surface 214 of the anchor 210 may be configured for attachment to a vertical-surface 10. The vertical-surface 10 may be a wall. As shown, the exercise-system may further include at least one fastening-means for fastening the anchor 210 to the wall. In on example, the fastening-means may be a screw. Shown here is four screws attaching the anchor 210 to the wall at each corner.

Figure 9:
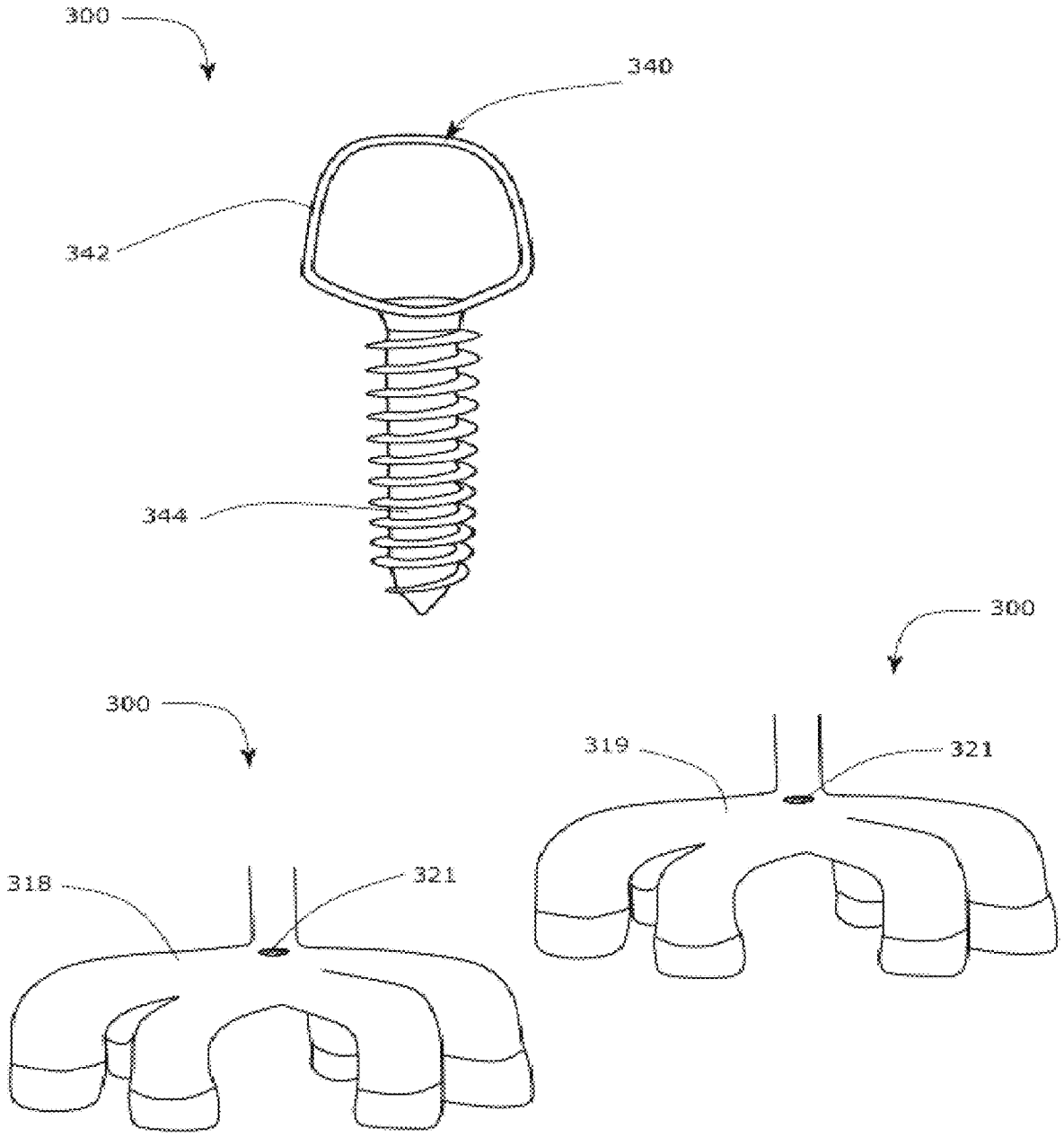
FIG. 9 is a perspective view of the mounts of the exercise system of FIG. 6 in one embodiment, according to an embodiment of the present disclosure.

FIG. 6 shows a front perspective view of an exercise-system 300, according to an embodiment of the present disclosure. As illustrated, the exercise-system 300 may include an exercise-support 310, a first exercise-accessory 320, a second exercise-accessory 330 and at least one attachment screw-hook 340 (FIG. 9).

The exercise-support 310 may include a first horizontal-bar 312, a first vertical-support 314; a second vertical-support 316, a first-base 318 and a second-base 319. As shown here, the second vertical-support 316 may be located opposite the first vertical support, and the first vertical support and the second vertical support may be configured together to elevate the first horizontal bar. The first-base 318 may be removably attached to a first base-end of the first vertical-support 314. Similarly, the second-base 319 may be located opposite the second-base 319, and may be removably attached to a second base-end of the second vertical-support 316.

The first exercise-accessory 320 may include at least one support hook 322, at least one hand grip 324 and at least one arm support 326. The at least one support hook 322 may be configured to couple to the horizontal bar and to support at least 50 pounds from the horizontal bar. Further, the at least one hand grip 324 may be coupled to the support hook 322 and positioned adjacent to the support hook 322. In addition, the at least one arm support 326 may be coupled to the at least one hand grip 324 and positioned adjacent to the hand grip 324 and opposite the support hook 322, the arm support 326 configured to receive an arm of a user 40 and to support the user 40 via the arm of the user 40.

Further, the second exercise-accessory 330 may include the same elements as the exercise-accessory 100 as above: the at least one resistance-band 110 having the first-end 112, the second-end 114 opposite the first-end 112 and the length 116 therebetween; the first-end 112 including the first attachment-clip 117, and the second-end 114 including the second attachment-clip 118; and the at least one foot-section 120 having the at least one first attachment-hook and the at least one adjustable-strap 123; the at least one attachment-hook 122 being configured for attachment to one of the first attachment-clip 117 and the second attachment-clip 118. As shown and as above, the foot-section 120 may be configured to receive and hold a foot of a user 40. Further, the at least one attachment screw-hook 340 may be configured to provide a means to attach the resistance-band 110 to one of the first-base 318 and the second-base 319.

Figure 7:
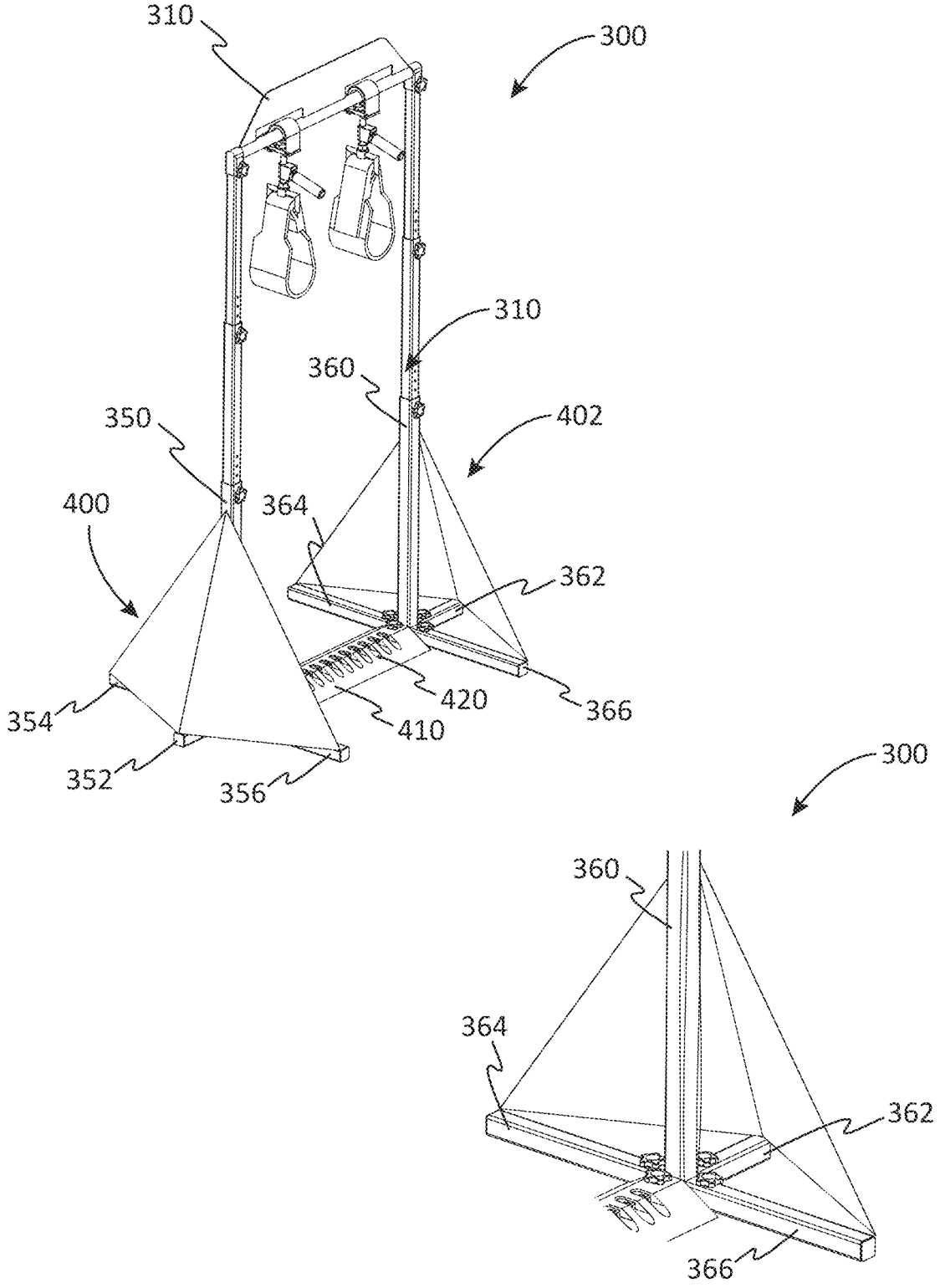
FIG. 7 is a perspective view of the exercise system of FIG. 6, according to an embodiment of the present disclosure.
Figure 8:
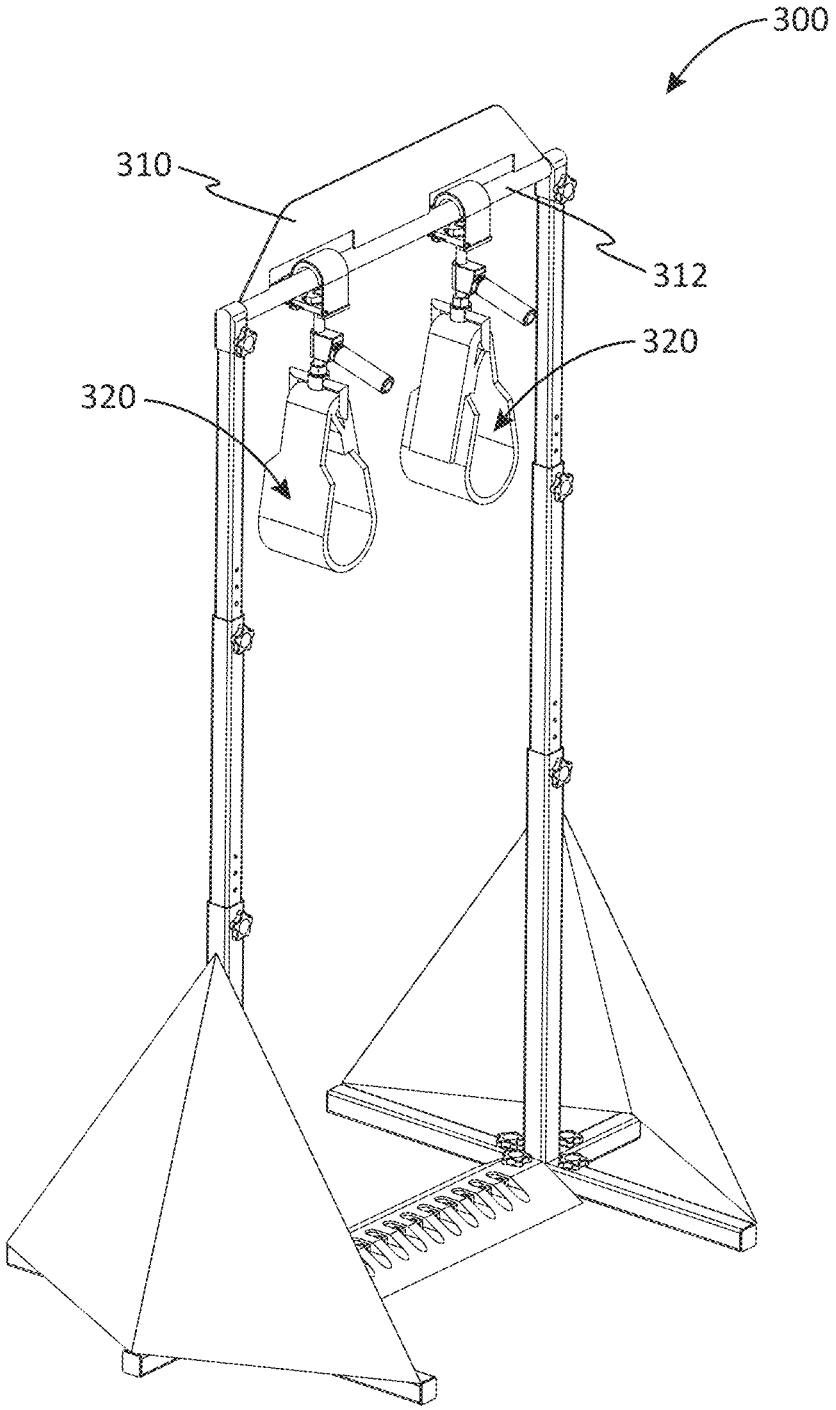
FIG. 8 is a perspective view of the exercise system of FIG. 6, according to an embodiment of the present disclosure.

FIG. 7 shows a side-front perspective view of the exercise accessory 300 of FIG. 6, according to an embodiment of the present disclosure. As shown in this figure, and as shown in FIGS. 6-8, the exercise-system 300 may further include a first-stabilizer 350 for removable attachment to the first-base 318, and a second-stabilizer 360 for removable attachment to the second-base 319. As shown, the first-stabilizer 350 may include a first outside-leg 352, a first rear-leg 354 and a first front-leg 356. Similarly, the second-stabilizer 360 may include a second outside-leg 362, a second rear-leg 364 and a second front-leg 366. The first-stabilizer 350 and the second-stabilizer 360 may be placed over the first-base 318 and the second-base 319 of the exercise-support 310 respectively and situated such that the first outside-leg 352 and the second outside-leg 362 are located on an outside of the exercise-support 310; the first rear-leg 354 and the second rear-leg 364 are located on a rear side of the exercise-support 310; and the first front-leg 356 and the second front-leg 366 are located on a front side of the exercise-support 310. The first-stabilizer 350 and the second-stabilizer 360 may be configured to provide additional support to the exercise-support 310 when in use, to prevent the exercise-support 310 from slipping or falling over.

Each of first-base 318 (FIG. 6) and second-base 319 (FIG. 6) may include first-tripod 400 and second-tripod 402. Baseplate 410 may bridge first vertical-support 318 and second vertical-support 319 and may lie flat against a floor when exercise-system 300 is in use. At least one mount 420 may be mounted to baseplate 410. At least one mount 420 may be a ring or slot. At least one mount 420 may configured for attachment to another of the first attachment-clip 117 (FIG. 6) and the second attachment-clip 118 (FIG. 6).

FIG. 8 shows a front-side perspective view of the exercise-system 300 of FIG. 6, according to an embodiment of the present disclosure. As shown in this figure, the user 40 may utilize the exercise-support 310 with either the first exercise-accessory 320, the second exercise-accessory 330 (FIG. 6) or both. Shown here, the user 40 (FIG. 6) is able to use the exercise-support 310 and two of the first exercise-accessories to perform pull-ups on the first horizontal-bar 312.

FIG. 9 shows a front perspective view of the exercise-system 300 of FIG. 6, according to an embodiment of the present disclosure. As discussed above, the exercise-system may include the at least one attachment screw-hook 340. As shown, the at least one attachment screw-hook 340 may include a hook-end 342 and a screw-end 344. The hook-end 342 may configured for attachment to another of the first attachment-clip 117 and the second attachment-clip 118 (FIG. 6), and the screw-end 344 configured to attach the at least one attachment-hook 122 to one of the first-base 318 and the second-base 319. To aid in this, in the preferred embodiment, the first-base 318 and the second-base 319 may each include a screw-aperture 321 configured to receive the screw-end 344 of the at least one attachment screw-hook 340. In one example, the screw-aperture 321 may include a female-thread, and the screw-end 344 may include a male-thread configured to mate with the female-thread and securely attach the at least one attachment screw-hook 340 to the first-base 318 or the second-base 319 (in the preferred embodiment) the at least one attachment screw-hook 340 may include two attachment screw-hooks and one may be attached to each base.

Figure 10:
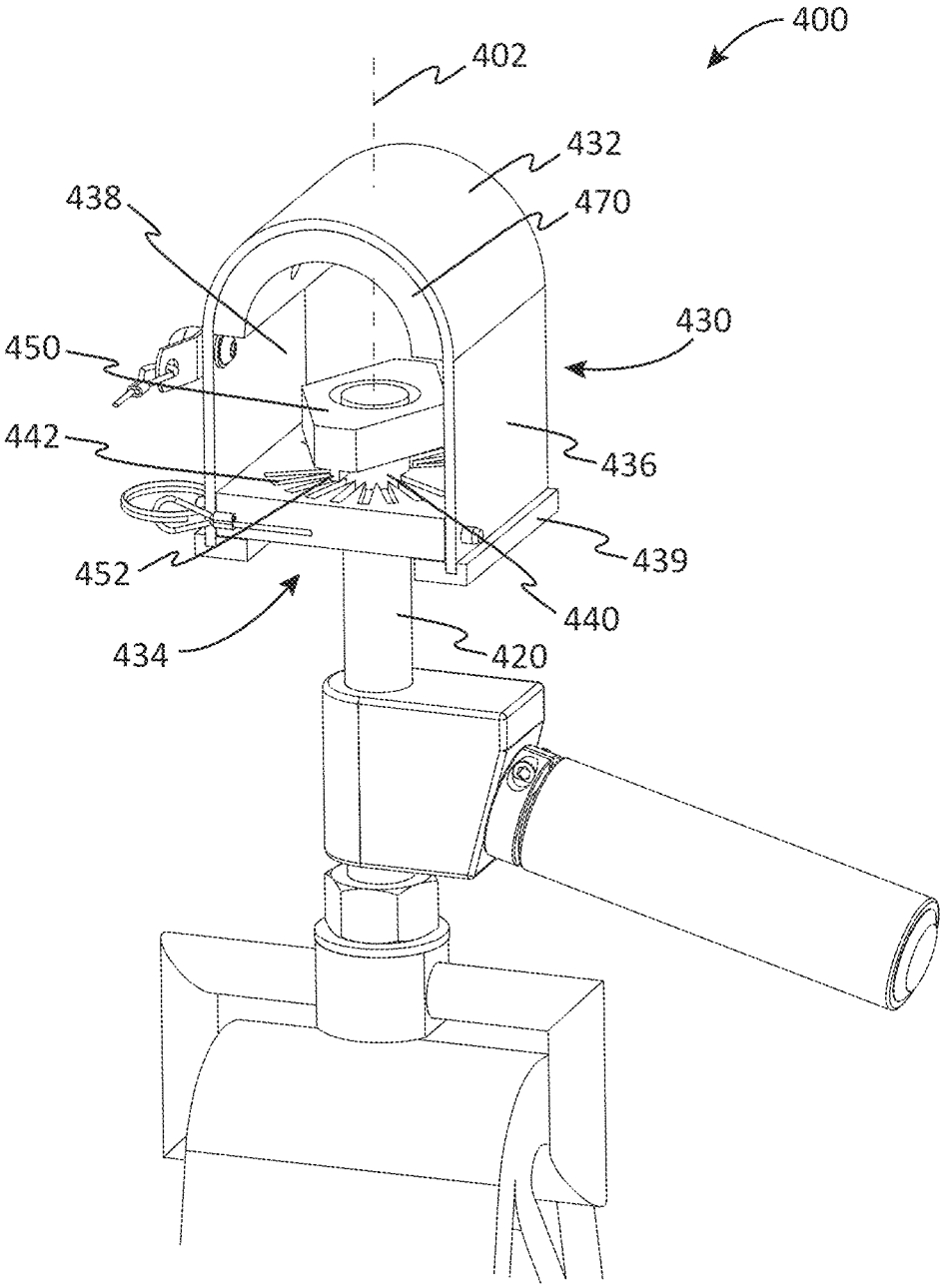
FIG. 10 is a front perspective view of the angular adjuster of the exercise system of FIG. 6, according to an embodiment of the present disclosure.

FIG. 10 shows the first-exercise accessory 320 (which will also be referred to as the arm-pull). The arm-pull 320, as before, includes at least one support hook 322, at least one hand grip 324 and at least one arm support 326. At least one arm support 326 is preferably a fabric sling looped into connecting-member 328. Connecting-member 328 may suspend at least one arm support 326 from at least open support hook 322. At least one hand grip 324 is affixed to connecting member 328, and may, in an exemplary embodiment, cantilever out from connecting member 328 at an angle greater than forty-five degrees. Preferably, the angle is approximately seventy-five degrees, as in the illustrated embodiment. Connecting member 328 may comprise angular-adjuster 400. Angular-adjuster 400 is configured to enable a user to rotate at least one arm support 326 relative to at least one support hook 322 along a suspension-axis 402. Suspension-axis 402 is defined by the axis along which connecting-member 328 extends, as illustrated. In other terms, suspension-axis 402 is the line defined by endpoints at support hook 322 and at least one arm support 326. Accordingly, a user may adjust the angular position of at least one arm support 326, and thereby chose an optimum angle at which the user may position his or her wrists most comfortably when performing pull-ups or similar exercises.

Angular-adjuster 400 may divide connecting member 328 into upper section 410 and lower section 420. Alternatively, angular-adjuster may comprise upper section 410 (as shown in the illustrated embodiment, angular-adjust mounts directly to first horizontal-bar 312). Angular-adjuster 400 may itself include adjuster-cage 430 and indexer 450. Adjuster-cage may have band 432 which is able to mount directly about first horizontal-bar 312. As illustrated, band 432 is preferably a rigid band having a curvature that circles over the top of first horizontal-bar 312 when installed, thereby provided means for articulation, such that first-exercise accessory 320 may swing along this curvature. Band 432 forms the upperside of adjuster-cage 430. Further, band 432 may be one and the same as at least one support hook 322 (FIG. 6). Adjuster-base 434 may form the lower portion of adjuster-case 430. According, the combination of adjuster-base 434 and band 432 are integral to each other and form a continuous cage. Adjuster-base is preferably a flat, square plate. Band 432 is a semi-circular arch, preferably with parallel front end 436 and back end 438. Front end 436 and back end 438 are identical and mirror each other. Band 432 preferably meets adjuster-base 434 at orthogonal corners 439, as illustrated (although these corners may be chamfered or rounded).

Adjuster-base 434, on an upperside (that is, the side facing band 432), includes aperture 440 and plurality of radially-arrayed tines 442 circumscribing aperture 440. Plurality of radially-arrayed tines 442 face upwardly (that is, towards band 432). Indexer 450 has at least one indexer-tine 452 (but preferably a pair of indexer-tines 452) that are sized to shaped to index to any of radially-arrayed tines 442. In such a way, indexer 450 may rest with adjuster-cage 430 and index to plurality of radially-arrayed tines 442. Further, indexer 450 may be affixed to lower section 420 of connecting-member 328, and lower section 420 may extend downwardly (that is, away from band 432) through aperture 440. When lower section 420 is affixed to indexer 450 and indexer 450 is within adjuster-cage 430, this captures and retains indexer 450 within adjuster-cage 430. In some embodiments, lower section 420 may be threaded into indexer 450. When a user lifts him or herself up on first-exercise accessory 320, the force of gravity draws indexer 450 down into plurality of radially-arrayed tines 442, thereby preventing the adjustment and the index from withdrawing or coming out of alignment. However, in some embodiments, additional fasteners may be implemented to positively retain indexer 450 to plurality of radially-arrayed tines 442 at all times. In a preferred embodiment, at least one indexer-tine 452 includes left-tine 454 and right-tine 456, which mirror each other to either side of aperture 440 when lower section 420 is installed within aperture 440, such that weight is distributed evenly to either side of indexer 450.

Band 432 may further include cushion 470 which is positioned in the underside of the curvature within adjuster-cage 430. Cushion 470 may prevent impingement and damage from indexer 450 striking band 432.

Figure 11:
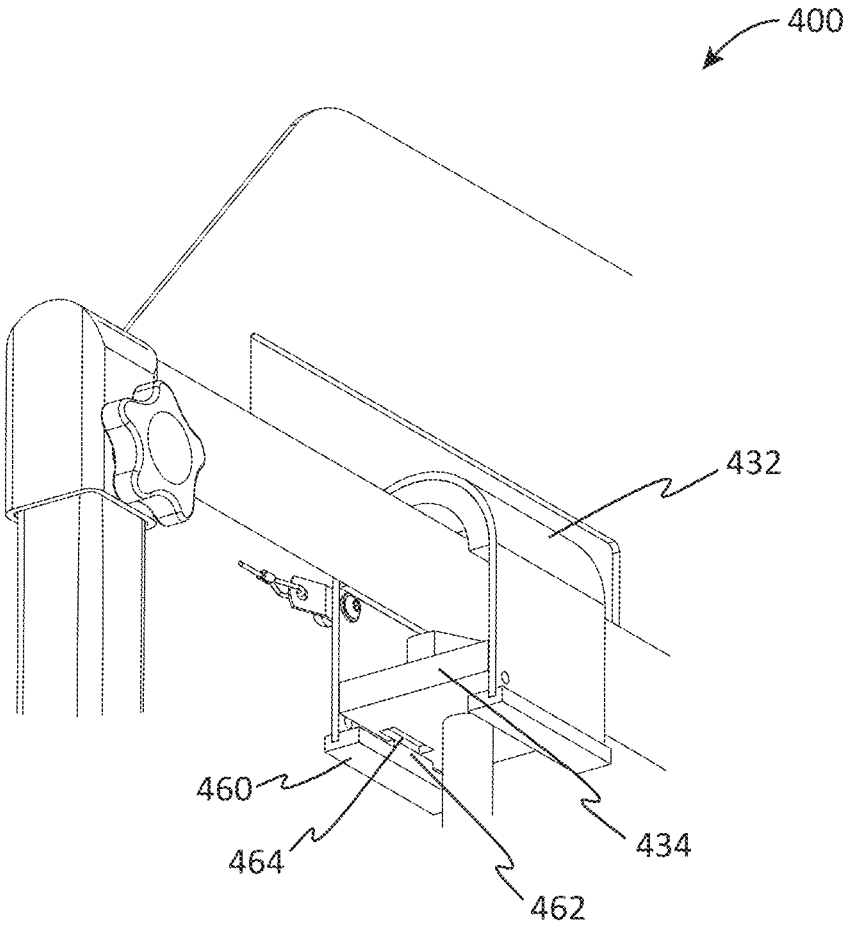
FIG. 11 is a bottom perspective view of the angular adjuster of the exercise system of FIG. 6, according to an embodiment of the present disclosure.

FIG. 11 shows additional details of angular-adjuster 440. In some embodiments, adjuster-base 434 is separable from band 432. As shown, front end 436 and back end 438 may terminate in ears 460 which face inwardly towards each other and upon which adjuster-base 434 may nest. Each of ears 439 may include protrusion 462. Correspondingly, adjuster-base may include one or more notches 464 (preferably two, one for each ear) which index to each protrusion 462. Each of protrusions 462 and notches 464 may be rectangular in shape, although other geometries may be utilized. Further, in some embodiments, positive fasteners may be substituted or added to retain adjuster-base 434 to band 432.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An exercise system comprising:

an angular-adjuster configured to couple to a horizontal bar, the angular-adjuster comprising a cage including a rigid band having a curvature, a front end, and a back end parallel to the front end, such that the curvature is adapted to circumscribe the horizontal bar when the exercise accessory is installed to the horizontal bar, thereby enabling rotational articulation of the angular-adjuster about the horizontal bar, a base which bridges the front end to the back end, an aperture perforating the base, and a plurality of radially-arrayed tines circumscribing the aperture and facing towards the curvature, and an indexer including at least one tine, the at least one tine being sized and shaped to index to any of the radially-arrayed tines;

an arm support able to accept a user's forearm, the arm support comprising a flexible sling;

a connecting-member suspending the arm support from the angular-adjuster, the connecting-member being affixable to the indexer and passing through the aperture; and a hand grip affixed to the suspension member and cantilevering out from the suspension member.

2. The exercise system of claim 1, wherein the indexer includes a first-tine and a second-tine, the first-tine and the second-tine being colinear and separated by one-hundred-and-eighty degrees.

3. The exercise system of claim 1, wherein the connecting member is a cylindrical rod.

4. The exercise system of claim 1, wherein the connecting member comprises a threaded end and the indexer comprises a threaded aperture, such that the threaded end may affix to the threaded aperture.

5. The exercise system of claim 1, further comprising a cushion nested within a concave side of the curvature of the band.

6. The exercise system of claim 1, further comprising a resistance-band having a first-end, a second-end, and a length therebetween, the resistance band being linearly expandable;

a first attachment-clip coupled to the first-end;

a second attachment-clip coupled to the second-end;

a shoe coupled to the second-end and able to receive a foot of a user, the shoe having a heel, such that the second-end couples to the heel of the shoe, and the resistance-band thereby provides resistance as the heel is pulled away from the first end;

a power source;

a sensor system configured to track user parameters and workout metrics, and communicate data directly to at least one smart device; and a wireless transmitter able to communicate the data with a network and said at least one smart device.

7. The exercise system of claim 6, wherein the first attachment-clip includes a first spring-loaded gate configured to bias in a closed position under a spring pressure, and to move into an open position when the spring pressure is overcome.

8. The exercise system of claim 6, wherein the second attachment-clip includes a second spring-loaded gate configured to bias in the closed position under the spring pressure, and to move into the open position when the spring pressure is overcome.

9. The exercise system of claim 6, wherein the first attachment-clip is moveable along the length of the resistance-band.

10. The exercise system of claim 6, wherein the first-end includes a first adjustable-button configured to selectively unlock and lock the first attachment-clip along the length of the resistance-band.

11. The exercise system of claim 6, wherein the first-end includes a first clip-stopper to prevent removal of the first attachment-clip from the first-end of the resistance-band.

12. The exercise system of claim 6, wherein the second attachment-clip is moveable along the length of the resistance-band.

13. The exercise system of claim 6, wherein the second-end includes a second adjustable-button configured to selectively unlock and lock the second attachment-clip along the length of the resistance-band.

14. The exercise system of claim 6, wherein the second-end includes a second clip-stopper to prevent removal of the second attachment-clip from the second-end of the resistance-band.

15. The exercise system of claim 6, wherein the at least one attachment-hook includes two attachment-hooks.

16. The exercise system of claim 6, wherein the resistance-band comprises a durable rubber material.

17. An exercise system comprising:

an exercise-support including:

a horizontal bar;

a first vertical-support;

a second vertical-support opposite the first vertical support, the first vertical support and the second vertical support coupled together by the horizontal bar;

a first-base removably attached to a first base-end of the first vertical-support; and a second-base opposite the second-base, the second-base being removably attached to a second base-end of the second vertical-support;

an angular-adjuster configured to couple to the horizontal bar, the angular-adjuster comprising a cage including a rigid band having a curvature, a front end, and a back end parallel to the front end, such that the curvature may circumscribe the horizontal bar when the exercise accessory is installed to the horizontal bar, thereby enabling rotational articulation of the angular-adjuster about the horizontal bar, a base which bridges the front end to the back end, an aperture perforating the base, a plurality of radially-arrayed tines circumscribing the aperture and facing towards the curvature, an indexer including at least one tine which is sized and shaped to index to any of the radially-arrayed tines, an arm support able to accept a user's forearm, the arm support comprising a flexible sling;

a connecting-member suspending the arm support from the angular-adjuster, the connecting-member being affixable to the indexer and passing through the aperture;

a hand grip affixed to the suspension member and cantilevering out from the suspension member;

at least one resistance-band having a first-end, a second-end opposite the first-end and a length therebetween, the first-end including a first attachment-clip, and the second-end including a second attachment-clip; and at least one foot-section having at least one first attachment-hook and at least one adjustable-strap, the at least one attachment-hook being configured for attachment to one of the first attachment-clip and the second attachment-clip, and wherein the foot-section is configured to receive and hold a foot of a user; and at least one mount to which the attachment-clip may affix.

18. The exercise system of claim 17, further comprising a first-tripod having a first tripod-aperture able to accept and circumscribe the first vertical-support;

a second-tripod having a second tripod-aperture able to accept and circumscribe the second vertical-support;

a baseplate coupling and bridging the first base-end of the first vertical-support and the second base-end of the second vertical-support, the baseplate paralleling the horizontal bar; and at least one mount mounted to the baseplate.

* * * * *